US005580338A

United States Patent [19]

Scelta et al.

[11] Patent Number: 5,580,338

[45] Date of Patent: Dec. 3, 1996

[54] PORTABLE, UPPER BODY, EXERCISE MACHINE

[76] Inventors: Anthony Scelta, 3340 Pine Walk Dr., North #1524, Margate, Fla. 33063; Nestor J. Palacios, 85-10 34th Ave. #411, Jackson Heights, New York City, N.Y. 11372

[21] Appl. No.: 558,415

[22] Filed: Nov. 16, 1995

Related U.S. Application Data

[63] Continuation-in-part of Ser. No. 399,122, Mar. 6, 1995, abandoned.

[51] Int. Cl.[6] ..... A63B 21/22

[52] U.S. Cl. ..... 482/62; 482/60; 482/114

[58] Field of Search ..... 482/57, 62, 55, 482/124, 125, 114, 134, 139, 140, 148, 60, 904, 115

[56] References Cited

U.S. PATENT DOCUMENTS

| | | | |
|---|---|---|---|
| 2,668,709 | 2/1954 | Boyko . | |
| 2,817,524 | 12/1957 | Sadler | 272/79 |
| 3,216,722 | 9/1965 | Odom | 272/73 |
| 3,309,084 | 3/1967 | Simmons | 272/79 |
| 4,060,241 | 11/1977 | Hegel | 272/132 |
| 4,222,376 | 9/1980 | Prapotnick | 128/25 |
| 4,717,146 | 1/1988 | Nohara | 482/62 |
| 5,232,425 | 8/1993 | Miller et al. | 482/125 |

FOREIGN PATENT DOCUMENTS

| | | | |
|---|---|---|---|
| 1435830 | 3/1966 | France | 482/62 |
| 2421637 | 11/1979 | France | 482/55 |
| 1516401 | 7/1969 | Germany | 482/904 |

*Primary Examiner*—Stephen R. Crow
*Attorney, Agent, or Firm*—Robert W. J. Usher

[57] ABSTRACT

A housing containing a hand cranked, flywheel type resistance mechanism is mounted upstanding from a base. The base is formed by a housing supporting pillar member from which a thigh brace depends and a lap rest adjustably and releasably secured to extend horizontally from the pillar member by engagement of selected vertically spaced ribs on the pillar and a pillar receiving slot in the slot. The flywheel type resistance mechanism comprises a friction band in encircling frictional engagement with a flywheel thereby to resist rotation thereof. An adjustable band tensioner is provided to adjust the frictional resistance to rotation. A body belt is releasably attached to the pillar to secure the apparatus to a user's waist.

19 Claims, 8 Drawing Sheets

PORTABLE, UPPER BODY, EXERCISE MACHINE

This application is a continuation of Ser. No. 08/399,122 filed Mar. 6, 1995, now abandoned.

FIELD OF THE INVENTION

The invention relates to a portable exercise machine by which users may exercise their upper bodies while in a sitting position and more particularly to a exercise machine of the type in which a hand crank is rotatable against a variable resistance.

BACKGROUND OF THE INVENTION

It is well recognized in the health and fitness industry, that aerobic exercise should be done at regular intervals over an extended period of time in order to build up a sufficiently high level of fitness for the full benefit thereof to be obtained. Sporadic attempts at exercising are often at best only marginally effective. For various reasons ranging from disability to inconvenience many people barely exercise at all. A most common experience is the lack of time perceived as available for dedication to regular appearances at a gym or other exercise facility. Accordingly, many different types of exercise machines involving reciprocal motion, have been proposed to maximize the muscular range and intensity of exercise enabling the benefit thereof to be optimized in a minimum time period and different fitness levels to be accommodated.

For example, the prior art abounds with hand crank type exercise machines as taught by U.S. Pat. No. 3,309,084 issued Mar. 14, 1967; U.S. Pat. No. 4,222,376 issued Sep. 16, 1980; U.S. Pat. No. 4,521,012 issued Jun. 4, 1965; and U.S. Pat. No. 4,582,318 issued Apr. 15, 1986.

Each of the machines taught in the above mentioned prior patents suffers from a particular disadvantage. They may for example, be so bulky, cumbersome, complex and expensive as to deter home use. They are not portable or easily carried, restricting use to a single location, or require permanent installation, thereby reducing the opportunity for and, therefore, regularity of use even by an individual of average fitness. Furthermore, a disabled person, particularly one in a wheelchair, would be precluded from using those machines which require them to stand. The elderly, as well as pregnant women would not be advised to use these particular machines which tend to stress the lower back excessively in view of risk of strain

SUMMARY OF THE INVENTION

An object of the invention is to provide an exercise machine which eliminates or ameliorates the disadvantages mentioned above.

A further object of the invention is to provide a variable resistance, hand crank exercise machine which permits the user to exercise aerobically and anaerobically while strengthening the upper body.

An additional object of the invention is to provide an exercise machine that can be used, particularly in the home, by somewhat disabled, injured, elderly or pregnant individuals, essentially unaided, and while still remaining comfortable.

Yet another object of the present invention is to provide a small, light and portable exercise machine that can be readily carried enabling use in widely differing locations and environments such as in a park, a backyard, a laundromat, a moving car or other vehicle or even in outer space. The user may even be sitting watching television. This wide variety of possible environments and situations of use affords considerable increase in opportunity for use and, therefore, participation in exercise at the desired regularity.

It is another object of the invention to provide an exercise machine which is compact for easy storage in the home or car and which is of relatively simple and inexpensive construction with few moving parts for improved reliability and affordability.

Accordingly, in one aspect the invention provides, a portable, upper body, exercise machine by which users may exercise their upper bodies while in a sitting position comprising: a base; a flywheel housing mounted on said base to upstand therefrom; a flywheel mounted in the flywheel housing for rotation about a horizontal axis; means mounted in the housing for resisting rotation of the flywheel; hand crank means operatively connected to the flywheel and extending from respective opposite sides of the flywheel housing; the base comprising a horizontal lap rest and an elongate thigh brace depending from a central location of said lap rest and extending, in the longitudinal direction, between a front and a rear of the lap rest so that, when the lap rest is supported by a lap of a user with the thigh brace held between thighs of the user, the flywheel can be rotated against the resistance by a user operating the hand cranks to obtain upper body exercise.

The machine is essentially mounted and stabilized by the body of the user while leaving the arms free for operation of the hand cranks.

The invention provides cardiovascular benefits, tightens and tones the upper body of the user and burns calories without causing stress to the joints. It can also be used for rehabilitation of the shoulder and elbow. However, the significance of the invention extends beyond the immediate physiological benefits as the comfort, portability and simplicity encourage a desirably high frequency of use (3 to 5 times a week is recommended) as necessary for a strain free increase in total fitness level. Furthermore the machine can even be used by those unable to walk, in wheelchairs or bedridden, with lower limb injuries, or when pregnant.

According to another aspect, the invention provides a laptop, upper body, exercise machine by which users may exercise their upper bodies while in a sitting position comprising: a base comprising a horizontal lap rest and an elongate thigh brace depending from a central location of said lap rest and extending, in the longitudinal direction, between a front and a rear of the lap rest; a housing mounted upon the base above the lap rest; a manually operated reciprocal motion producing mechanism mounted in the housing; and, means mounted in the housing for providing resistance to the reciprocal motion so that, when the lap rest is supported by a lap of a user and the thigh brace held between thighs of the user, the reciprocal motion producing mechanism can be operated against the resistance by the user to obtain upper body exercise.

The invention also provides a portable, upper body, exercise machine by which users may exercise their upper bodies while in a sitting position comprising: a base; a flywheel housing mounted on said base; a flywheel mounted in the flywheel housing for rotation about a horizontal axis; means mounted in the housing for resisting rotation of the flywheel; hand crank means operatively connected to the flywheel and extending from respective opposite sides of the flywheel housing; and means mounting the base to the body of a user so that the flywheel can be rotated against the resistance by a user operating the hand crank means to obtain upper body exercise.

According to a further aspect, the invention provides a portable, upper body, exercise machine comprising: a base: a housing mounted on the base; a manually operated reciprocal motion producing mechanism mounted in the housing; means mounted in the housing for providing resistance to the reciprocal motion; and, means mounting the base on a user's body so that the reciprocal motion producing mechanism can be operated against the resistance by the user to obtain upper body exercise.

BRIEF DESCRIPTION OF THE DRAWINGS

Specific embodiments of exercise machine according to the invention will now be described by example only, with reference to accompanying drawings in which.

DESCRIPTION OF PARTICULAR EMBODIMENTS

Figure 1:
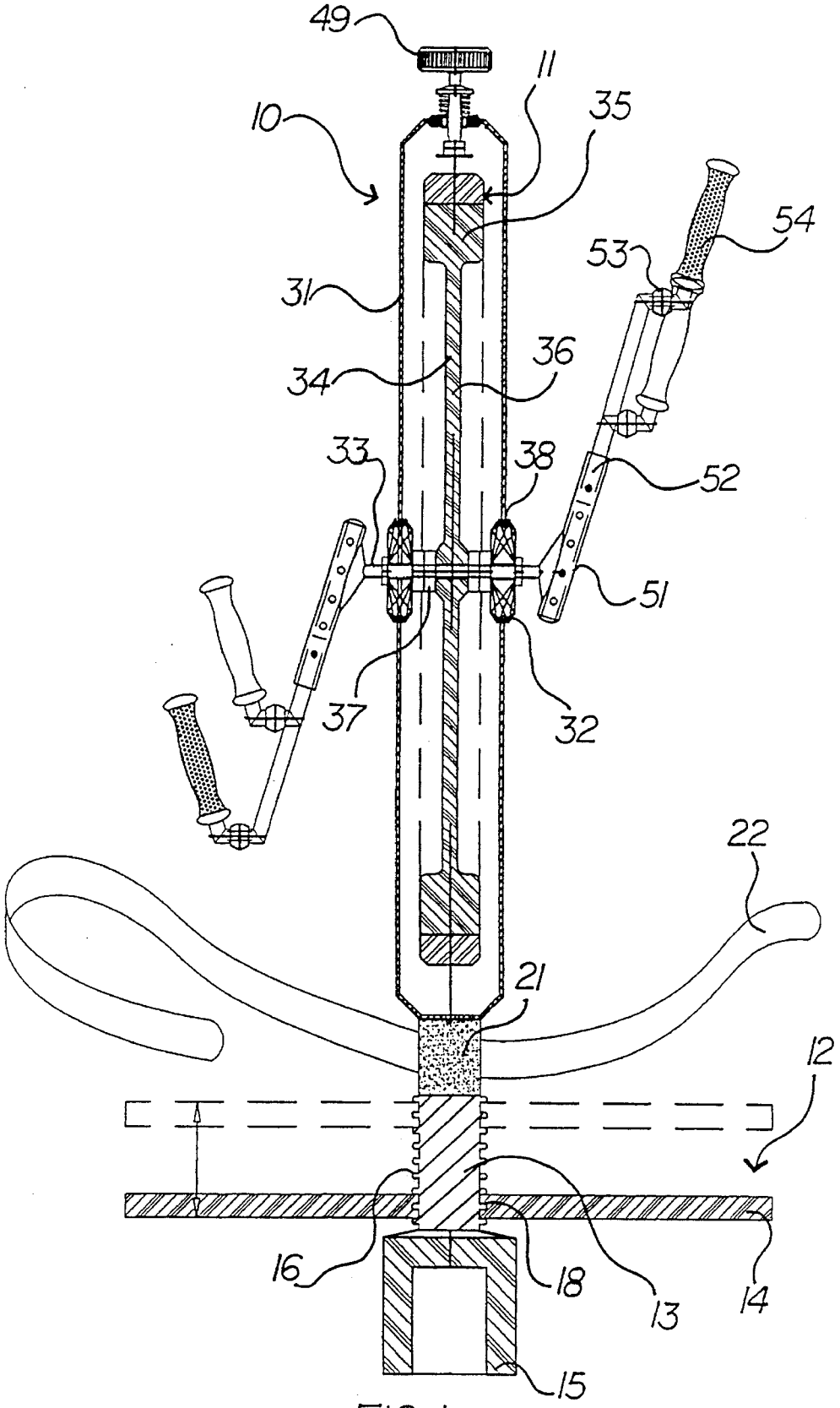
FIG. 1 is a schematic front elevation, partly in cross-section of a first embodiment of exercise machine according to the invention with a friction bond omitted.

As shown particularly in FIGS. 1–4, the exercise machine comprises a housing 10 containing a hand cranked, flywheel type resistance mechanism 11 mounted to upstand from a base 12.

The base 12 comprises a pillar member 13 supporting the housing, a substantially planar lap rest 14 releasably secured to the pillar member to extend substantially horizontally from respective opposite sides thereof, and an elongate thigh brace 15 depending from the pillar at a central location of said lap rest so as to extend, in the longitudinal direction, between a front and a rear of the lap rest 14. The thigh brace is cavitied for low weight, has a maximum width of approximately 5.5 inches and tapers rearward.

The pillar member is formed with a series of vertically spaced, parallel ribs or tongues 16 and the lap rest is formed with a central, pillar member receiving slot 17 which extends forward from an entry opening at a rear longitudinal edge thereof and is formed with a peripheral groove 18 engageable with a selected rib 16 to mount the lap rest 14 on the pillar member at selected alternative separations from the flywheel housing, thereby to accommodate users of different body sizes.

Figure 4:
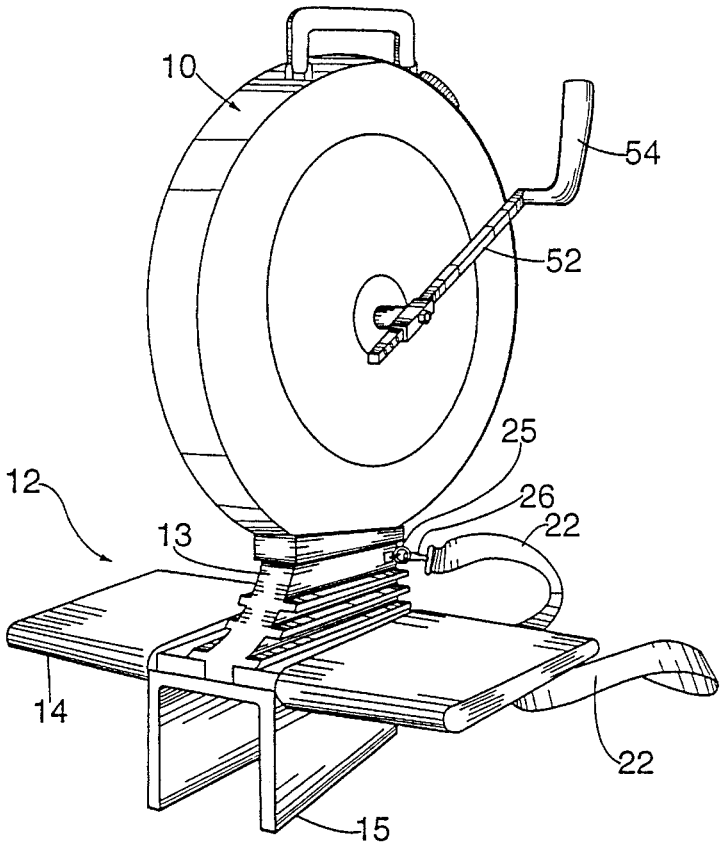
FIG. 4 is a front perspective view of a slightly modified embodiment.
Figure 5B:
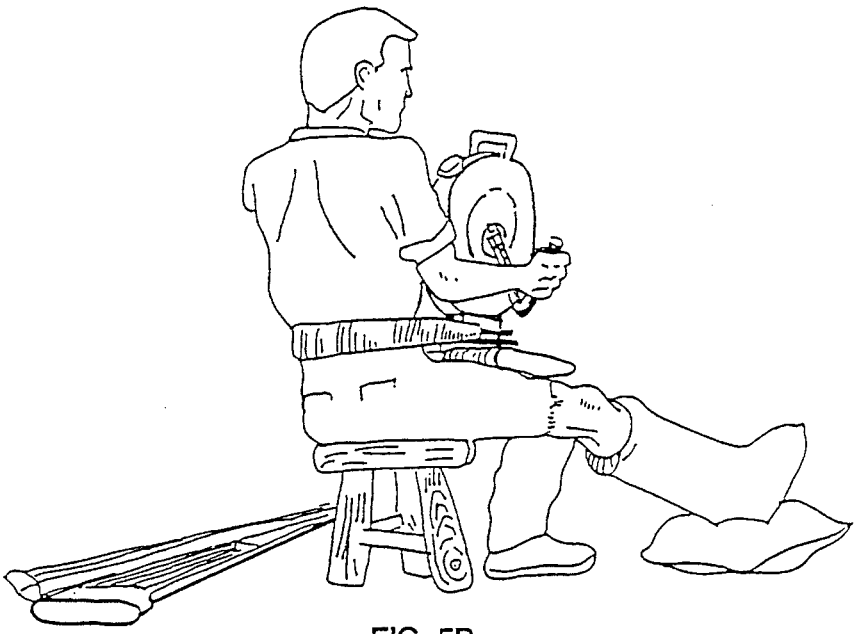
FIGS. 5(*a*)–5(*e*) are schematic perspective views illustrating use of the machine in different occupational positions corresponding to those of a seated athlete, a person with one leg in a cast, a pregnant woman, a car passenger, a "couch potato", and an astronaut, respectively.
Figure 5A:
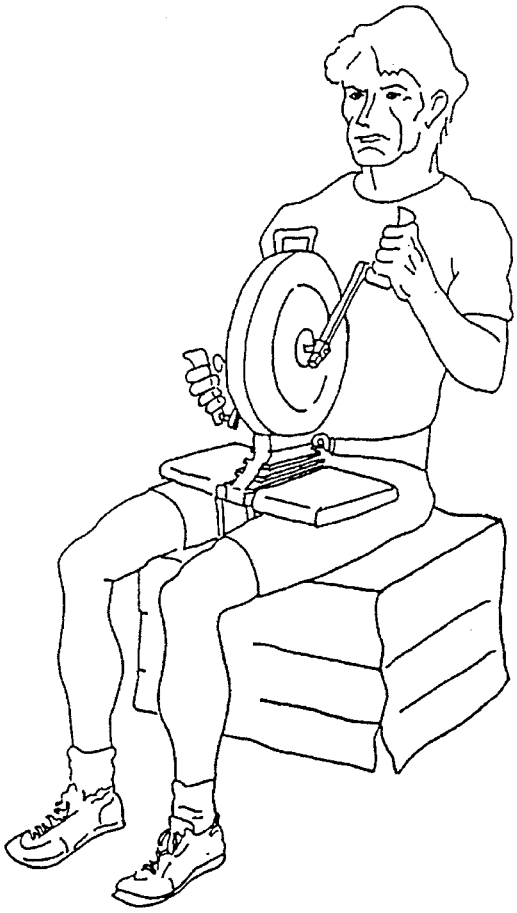
Figure 5C:
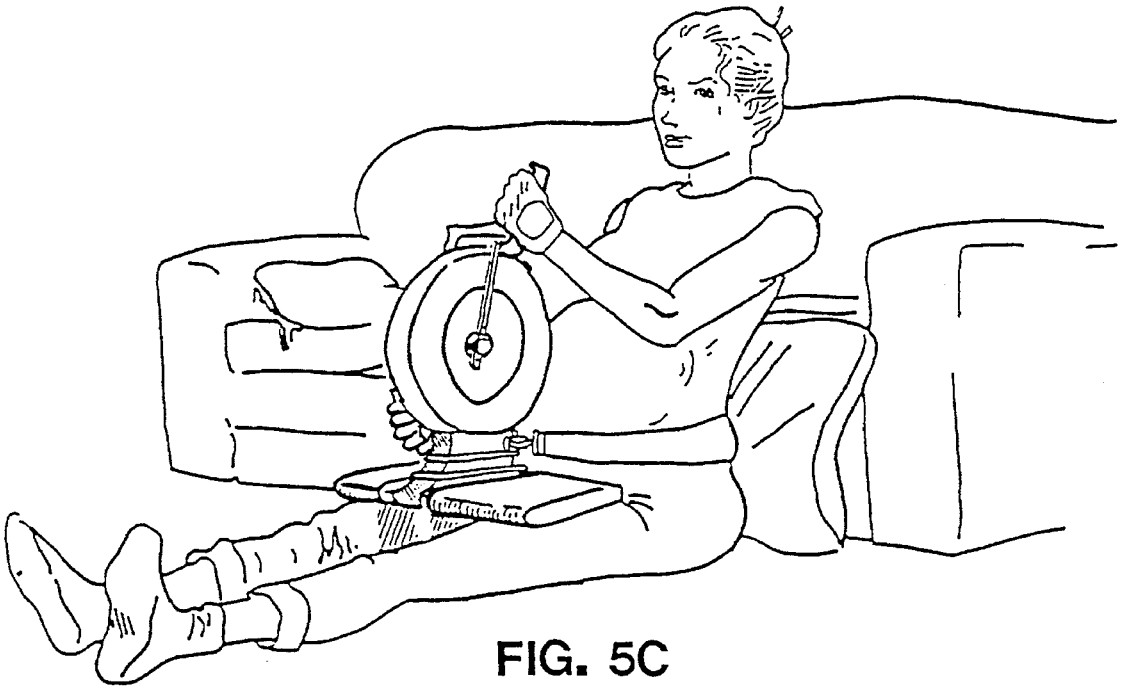
Figure 5D:
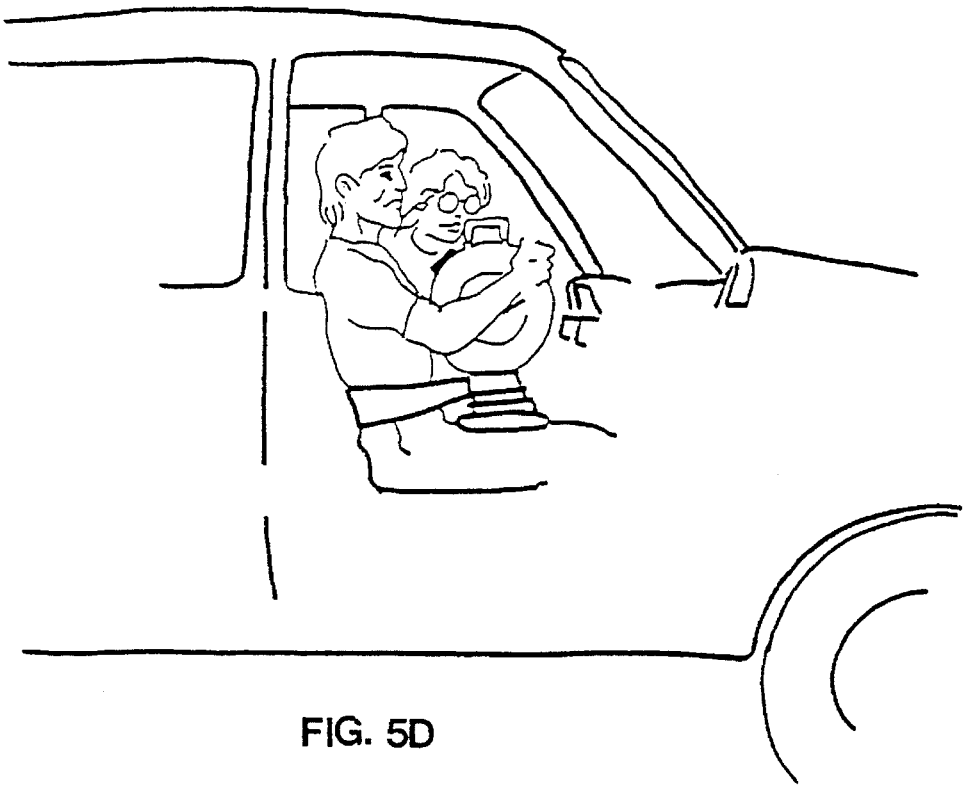
Figure 5E:
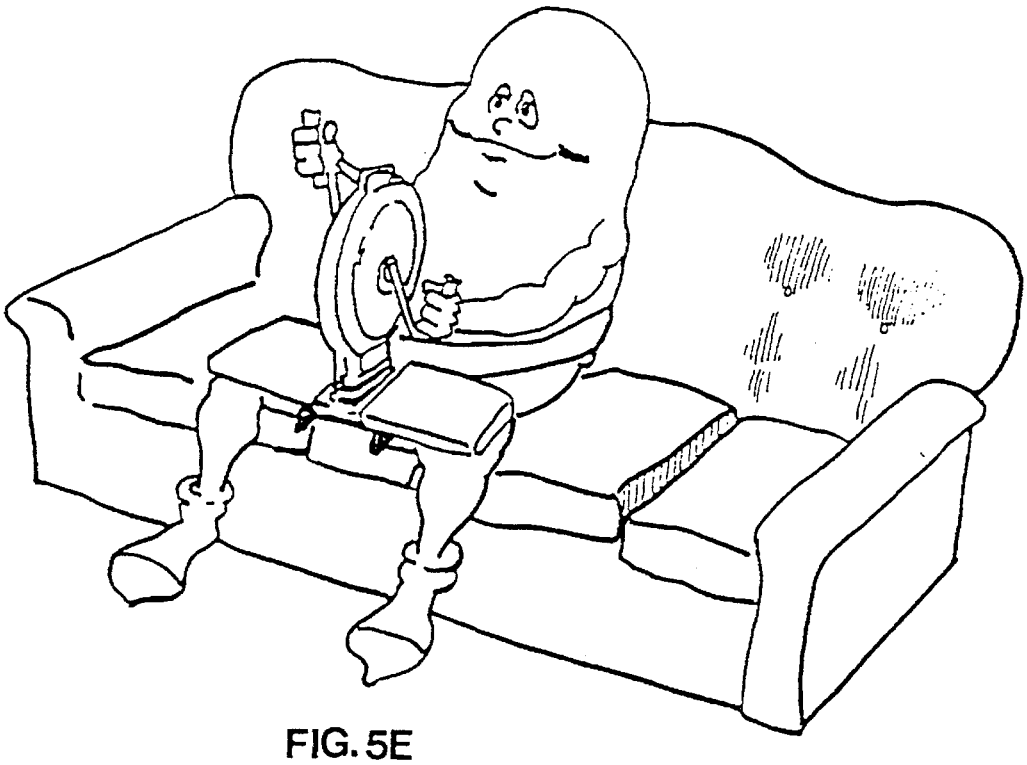

A hoop and loop type releasable fastening material 21 such as that sold under the trade mark VELCRO is attached to a portion of the pillar adjacent the housing for releasable securement of a body belt 22 by which the machine may be secured to a user's body. Alternatively, as shown in FIG. 4, the pillar is formed with an achoring eye 25 to which a metal clip 26 on the body belt 22 can be releasably attached.

The flywheel housing 10 comprises a substantially disk shape shell 31 molded as two identical half shells from suitable plastic material such as ABS (alternatively formed from a suitable light metal alloy, such as aluminium) and having a pair of hub bearings 32 mounted therein and between them rotatively receiving an axle 33 of a flywheel 34. The flywheel has a perimetrical edge portion or rim 35 of increased thickness made from a suitable metal alloy and a central web 36 of suitable plastic such as ABS. Omni directional spacers 37 are located on the axle between a hub portion 38 of the flywheel and the hub bearings 32.

A frictional resistance band 39 of nylon webbing extends in frictional engagement around a greater part of the outside of the rim of the flywheel and has opposite ends secured by respective tension springs 41 to a connecting plate 42. One member 43 of a rotational double bearing 44 is attached to a face of the connecting plate 42 and the other member 45 is carried by an inner end of a threaded rod 46 meshed with a threaded receiver or nut 47 anchored in shoulders 48 formed by a thickening in the housing half shells, the other end of the threaded rod 46 extending out from the housing and carrying a thumbwheel 49. A resistance spring 51 is captured extending around the threaded rod 46 between the shoulders 48 and a flange or skirt 52 formed on the threaded rod adjacent the thumbwheel 49.

It will be apparent that rotation of the thumbwheel 49 in alternative directions will withdraw and insert the threaded rod 46 into the housing, respectively, thereby moving the connecting plate outward and inward, respectively, to increase and decrease the tension in the springs 41 and band 39, producing a corresponding variation in the frictional resistance to rotation applied to the flywheel.

The flywheel is manually driven by a pair of hand cranks 51 each comprising an arm of telescopically adjustable aluminium tubing arm 52 which is fixed at one end to a respective end of the axle and inclines away from the housing to an opposite end connected by 360 degree rotational swivel bearings 53 to a hand grip 54.

Figure 2:
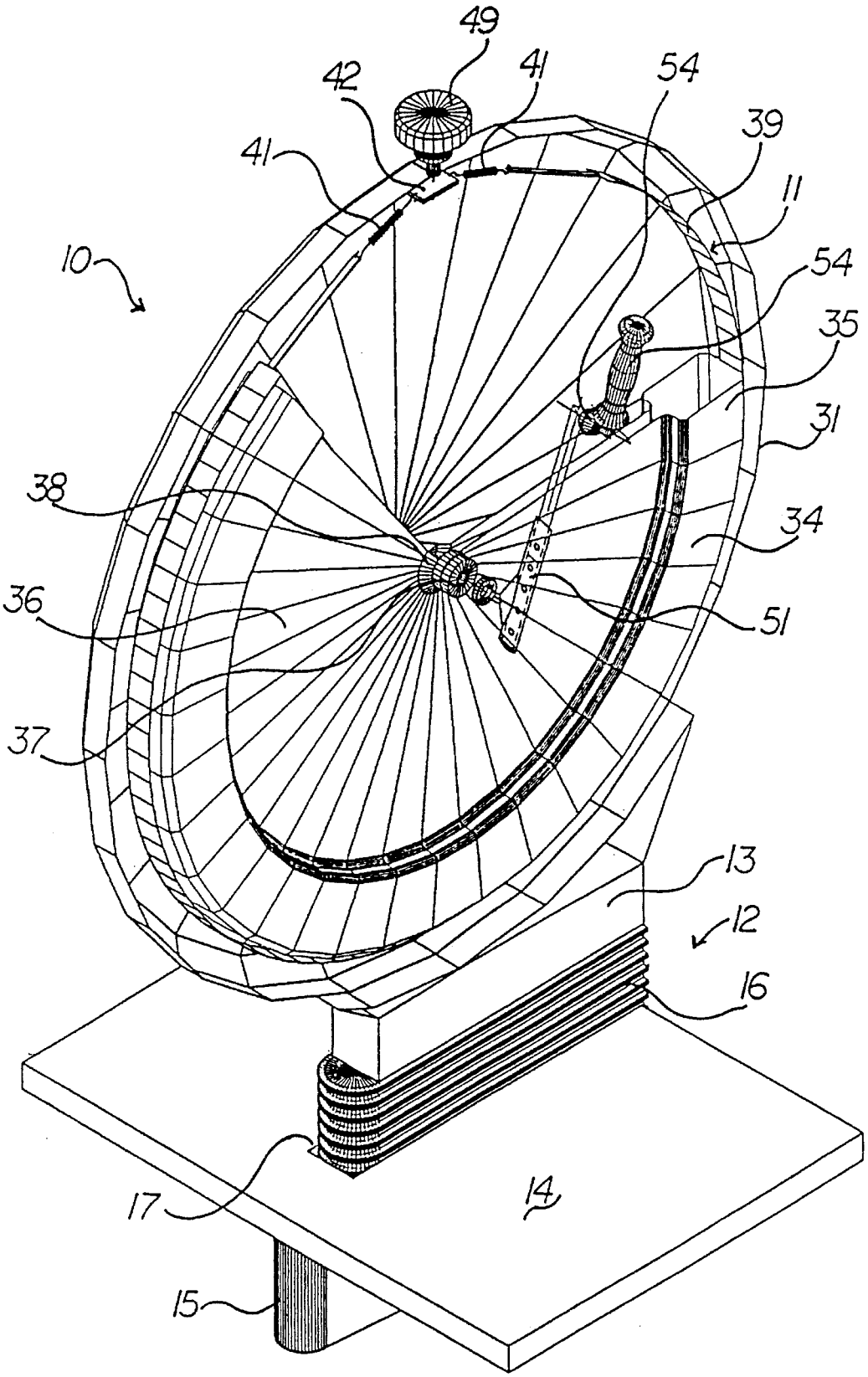
FIG. 2 is a schematic rear perspective view of the first embodiment with a part of a housing and flywheel thereof cut away.
Figure 3:
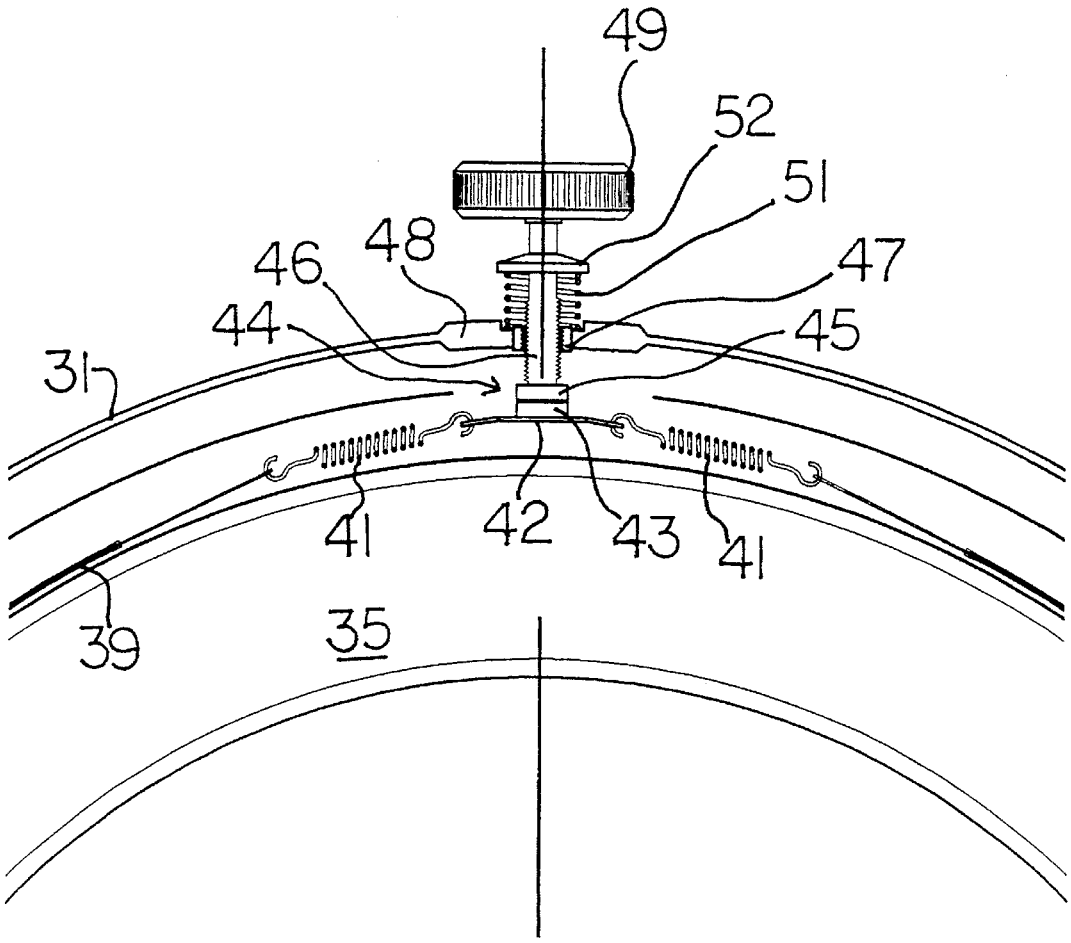
FIG. 3 is a schematic elevational view to greater scale with part of the housing cut away to show an adjustable frictional resistance mechanism in greater detail.

The embodiment shown in FIG. 4, differs essentially from that described with reference to FIGS. 1–3, in the provision of a carrying handle and in the front of the thigh brace remaining open as defined by two, spaced apart, elongate vertical wall members.

The machine may be operated in a variety of widely differing situations/environments as shown by FIGS. 5(*a*) to 5(*e*) and by users who would normally be Considered partly incapacitated.

As used by a normal healthy athletic type of person, shown in FIG. 5(*a*), the body belt is fastened extending around the waist with the user sitting on an elevated seat. The thigh brace extends between the thighs of the user to resist side to side movement and can be gripped by the thighs for additional stabilization.

However, as shown in FIG. 5(*b*), an individual with a leg in a cast can also use the machine, as when sitting on a stool, as a result of the provision of the lap rest, thigh brace and body strap which effectively supports the machine on the stationary body parts of the user leaving the arms and upper torso free for operation.

In addition, as shown in FIG. 5(*c*), the machine may be used by a pregnant woman while avoiding undesirable stress to the lower back.

Furthermore, as shown in FIG. 5(*d*), the same support characteristics enable a person to exercise while a passenger in a car or when sitting on a settee watching television as shown in FIG. 5(*e*).

As shown in FIG. 5(*f*), the machine can also help to solve the well recognized problem of obtaining sufficient exercise in space as it is supported entirely by the immobile body portions of the astronaut.

Figure 6:
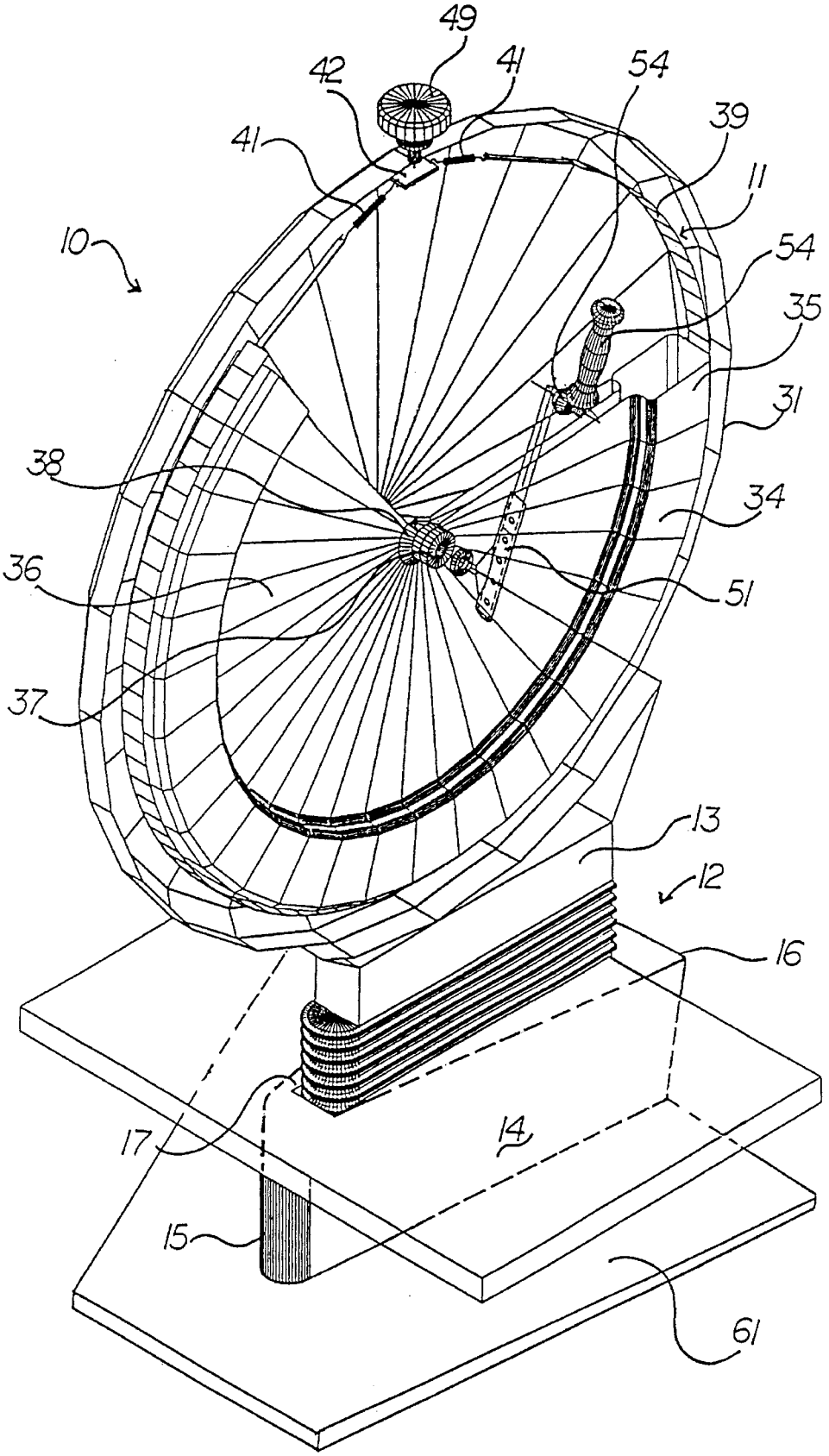
FIG. 6 corresponds to FIG. 2 and shows a further embodiment which includes a seat.

In other variants, a seat 61 is provided on the first and second embodiments, as shown in FIG. 6, attached to lowest points of the respective thigh braces and extending in generally underlying relation to the lap rest but protrude rearwardly therefrom. As the thigh brace is elongate, extending front to rear between the user's thighs, it can be engaged or gripped along the entire length on both sides by the user's thighs providing suffficient leverage to prevent the machine skewing or twisting about a vertical axis during energetic arm movement. The seat adds considerably to the stability of the machine in use, cooperating with the thigh brace to reduce or eliminate any tendency for the machine to rock or wobble during vigorous arm movement.

The seat and thigh brace may be formed as separate components or unit detachably attached to the pillar or stem by receipt thereof in a central slot 65 provided in the thigh brace.

Figure 7:
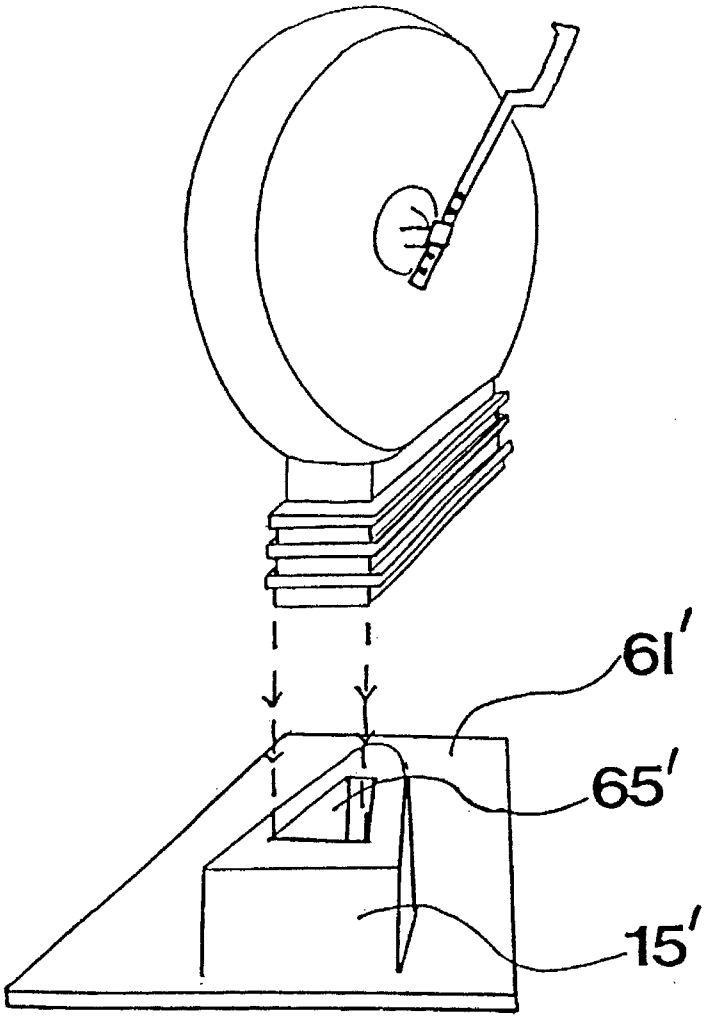
FIG. 7 is a diagrammatic exploded perspective of another embodiment in which the lap rest is omitted.
Figure 8:
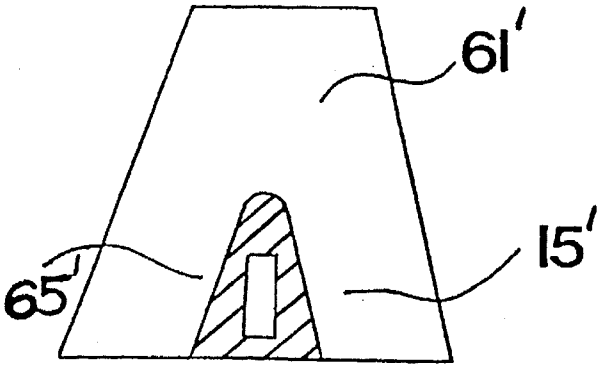
FIG. 8 is a plan view of the seat unit of the embodiment shown in FIG. 7.

As shown in FIGS. 7 and 8, in another embodiment, the lap rest is omitted entirely and the seat 61' and thigh brace 15' form an integral unit with the thigh brace 15' having a central slot 65' receiving the pillar or stem. A thumb screw (not shown) may be mounted on a side of the thigh brace to secure the pillar in the slot. The user's weight together with the pressure of the thighs on opposite sides of the thigh brace assure stability, preventing side to side movement.

It should also be noted that, as in the other examples described above, the center of mass or gravity of the machine passes substantially centrally through the thigh brace, (albeit displaced fractionally toward a rear) assuring maximum stability during rotation and obviating both any need for additional supports for the machine and any requirement for the user to lean forward, enabling the user to maintain the lower back in a desirably erect position which also obviates imposition of undesirable strain thereon.

We claim:

1. A portable, upper body, exercise machine by which users may exercise their upper bodies while in a sitting position comprising:

a base;

a flywheel housing mounted on said base to upstand therefrom;

a flywheel mounted in the flywheel housing for rotation about a horizontal axis;

means mounted in the housing for resisting rotation of the flywheel;

hand crank means operatively connected to the flywheel and extending from respective opposite sides of the flywheel housing:

the base comprising a horizontal lap rest and an elongate thigh brace vertically depending from a central location of said lap rest and extending, in the longitudinal direction, between a front and a rear of the lap rest so that, when the lap rest is supported by a lap of a user with the thigh brace held between thighs of the user, the flywheel can be rotated against the resistance by a user operating the hand cranks to obtain upper body exercise.

2. A machine according to claim 1 wherein the rotation resisting means comprises a friction band in encircling engagement with the flywheel thereby to resist rotation thereof.

3. A machine according to claim 2 wherein means are provided to adjust tension of the friction band thereby to adjust correspondingly the reistance to rotation applied to the flywheel.

4. A machine according to claim 1 wherein the base includes a pillar member extending supportingly between the flywheel housing and the thigh brace and formed with a series of vertically spaced one of tongue means and groove means, and the lap rest is formed with a central, pillar member receiving aperture having one of groove means and tongue means engageable with selected said one of tongue means and groove means to mount the lap rest on the pillar member at selected alternative separations from the flywheel housing thereby to accommodate users of different body sizes.

5. A machine according to claim 4 further including a body belt and releasable fastening means on a location of the pillar adjacent the flywheel for fastening the body belt thereto while encircling a users body thereby to secure the machine throughout operation to the body of the user.

6. A machine according to claim 5 wherein the releasable fastening means comprises one of a hook and loop fastening material on the said location and on the body belt, respectively.

7. A machine according to claim 1 wherein the hand crank means each comprises an arm adjustable in length and a handle mounted for swivelling movement on a free end thereof.

8. A machine according to claim 1 wherein the thigh brace has a rearward taper.

9. A laptop, upper body, exercise machine by which users may exercise their upper bodies while in a sitting position comprising:

a base comprising a horizontal lap rest and an elongate thigh brace vertically depending from a central location of said lap rest and extending, in the longitudinal direction, between a front and a rear of the lap rest;

a housing mounted upon the base above the lap rest;

a manually operated reciprocal motion producing mechanism mounted in the housing; and, means mounted in the housing for providing resistance to the reciprocal motion so that, when the lap rest is supported by a lap of a user and the thigh brace held between thighs of the user, the reciprocal motion producing mechanism can be operated against the resistance by the user to obtain upper body exercise.

10. A machine according to claim 9 wherein the thigh brace has a rearward taper.

11. A machine according to claim 9 wherein the base includes a pillar member extending supportingly between the housing and the thigh brace and formed with a series of vertically spaced one of tongue means and groove means, and the lap rest is formed with a central, pillar member receiving aperture having one of groove means and tongue means engageable with selected said one of tongue means and groove means to mount the lap rest on the pillar member at selected alternative separations from the flywheel housing thereby to accommodate users of different body sizes.

12. A machine according to claim 11 further including a body belt and releasable fastening means on a location of the pillar adjacent the flywheel for fastening the body belt thereto while encircling a users body thereby to secure the machine throughout operation to the body of the user.

13. A machine according to claim 12 wherein the releasable fastening means comprises one of a hook and loop fastening material on the said location and on the body belt, respectively.

14. A portable, upper body, exercise machine by which users may exercise their upper bodies while in a sitting position comprising:

a base having a front and a rear;

a flywheel housing mounted on said base;

a flywheel mounted in the flywheel housing for rotation about a horizontal axis and having a plane of rotation extending forward and rearward;

means mounted in the housing for resisting rotation of the flywheel;

hand crank means operatively connected to the flywheel and extending from respective opposite sides of the flywheel housing;

the base comprising a seat extending horizontally below the flywheel and an elongate vertical thigh brace extending forwardly and rearwardly between the flywheel housing and the seat in the plane of rotation of the flywheel so that a center of gravity of the flywheel passes through the thigh brace and so that the flywheel can be rotated against the resistance by a user operating the hand crank means to obtain upper body exercise while sitting on the seat with the thighs of the user in longitudinal gripping engagement with the thigh brace to prevent lateral movement thereof.

15. A machine according to claim 1 further comprising a horizontal seat attached to a lower end of the thigh brace.

16. A machine according to claim 9 further comprising a horizontal seat attached to a lower end of the thigh brace.

17. A machine according to claim 15 in which the seat extends rearwadly beyond the thigh brace.

18. A machine according to claim 16 in which the seat extends rearwadly beyond the thigh brace.

19. A machine according to claim 16 in which the seat extends rearwadly beyond the thigh brace.

* * * * *